US005079890A

United States Patent [19]

Kubik et al.

[11] Patent Number: 5,079,890

[45] Date of Patent: Jan. 14, 1992

[54] SPACE FRAME STRUCTURE AND METHOD OF CONSTRUCTING A SPACE FRAME STRUCTURE

[76] Inventors: Marian L. Kubik; Leszek A. Kubik, both of 'Nadolnik', 17 Birchwood Drive, Ravenshead, Nottinghamshire, NG15 9EE, United Kingdom

[21] Appl. No.: 364,237

[22] Filed: Jun. 7, 1989

[30] Foreign Application Priority Data

Jan. 11, 1989 [GB] United Kingdom ..... 8900565

[51] Int. Cl.[5] ..... E04B 1/14; E04B 1/19; E04C 5/06; E04H 12/14

[52] U.S. Cl. ..... 52/648; 52/251; 52/263; 52/334; 52/340; 52/747

[58] Field of Search ..... 52/263, 334, 336, 648, 52/340, 341, 674, 795, 814, 251, 645, 646, 747

[56] References Cited

U.S. PATENT DOCUMENTS

| | | | |
|---|---|---|---|
| 553,305 | 1/1896 | Fordyce . | |
| 793,358 | 6/1905 | Doyle | 52/814 |
| 1,734,358 | 11/1929 | Yeager | 52/334 |
| 1,883,376 | 10/1932 | Hilpert et al. . | |
| 2,140,283 | 12/1938 | Faber . | |
| 2,199,152 | 4/1940 | Edge et al. . | |
| 2,382,138 | 8/1945 | Cueni | 52/334 |
| 3,103,025 | 9/1963 | Gassner et al. . | |
| 3,705,473 | 12/1972 | Yaffal-Rueda . | |
| 3,800,490 | 4/1974 | Conte . | |
| 3,967,426 | 7/1976 | Ault et al. | 52/263 X |
| 4,120,131 | 10/1978 | Carroll | 52/340 X |
| 4,201,023 | 5/1980 | Jungbluth . | |
| 4,630,417 | 12/1986 | Collier | 52/263 |
| 4,653,237 | 3/1987 | Taft | 52/334 |
| 4,700,519 | 10/1987 | Person et al. | 52/334 |
| 4,729,201 | 3/1988 | Laurus et al. | 52/334 |
| 4,800,694 | 1/1989 | Sasaki | 52/645 X |

FOREIGN PATENT DOCUMENTS

| | | | |
|---|---|---|---|
| 55504 | 7/1982 | European Pat. Off. . | |
| 2519664 | 11/1976 | Fed. Rep. of Germany . | |
| 937400 | 9/1963 | United Kingdom . | |
| 937439 | 9/1963 | United Kingdom . | |
| 1310023 | 3/1973 | United Kingdom . | |
| 2054694 | 2/1981 | United Kingdom | 52/648 |
| 2212185 | 7/1989 | United Kingdom | 52/648 |

OTHER PUBLICATIONS

Marks' Handbook, Lionel S. Marks, Second Edition, McGraw Hill, 1924, p. 418.

Manual of Steel Construction, AISC Inc., Eighth Edition, 1980, pp. 1–80 and 1–81.

*Primary Examiner*—John E. Murtagh
*Assistant Examiner*—Deborah McGann Ripley
*Attorney, Agent, or Firm*—Reed Smith Shaw & McClay

[57] ABSTRACT

A space frame structure has parallel spaced lower and upper sub-frames joined by interconnecting members, each sub-frame comprising a multiplicity of members connected in a grid, and a concrete layer secured to the upper sub-frame, wherein the concrete layer embeds the grid members of the upper sub-frame in the layer to form a composite upper sub-structure. Preferably the structure comprises permanent shuttering supported on the grid members of the upper sub-frame within the depth of the upper sub-frame, the concrete layer being laid on the shuttering to a depth sufficient to embed all of the grid members above the shuttering in the layer.

12 Claims, 4 Drawing Sheets

SPACE FRAME STRUCTURE AND METHOD OF CONSTRUCTING A SPACE FRAME STRUCTURE

FIELD OF THE INVENTION

This invention relates to a space frame structure for use in bridging a space between supports. Such a structure is especially suitable for covering a substantial space with support only at the edges, the structure being otherwise self-supporting, with no need for intervening upright supports. Such structures commonly comprise upper and lower sub-frames interconnected by frame members to form a structure which is rigid in three dimensions.

Space frame structures are used, for example, for the roof structure of exhibition halls and factories, where a large space unencumbered by upright supports is important.

Conventional space frames have numerous diagonal frame members interconnecting the upper and lower sub-frame structures, but a much improved space frame, which is much simpler in construction, is disclosed in Patent No. GB 2054694B.

Space frames may carry a concrete layer. A space frame of this type is useful to form a floor and also in hot climates, where the concrete layer acts to absorb heat, and for sound absorption.

In a space frame structure with a concrete layer, it is conventional to provide steel shear connectors on the upper sub-frame structure and to lay the concrete on top of the upper sub-frame so that the shear connectors are embedded in the concrete layer. The shear connectors are usually round-headed studs projecting upwardly from the upper sub-frame. The usual reinforcement bars are also embedded in the concrete. The resultant space frame structure is heavy and of substantial depth.

A type of frame structure is described in U.S. Pat. No. 4,201,023 (Jungbluth). However, this differs from the space frame described in the aforementioned G.B. Patent in that it includes no upper sub-frame or grid of the type shown in the G.B. Patent. The structure described in Jungbluth appears to include preformed sheet-like members of, for example, reinforced concrete, connected to top portions of vertical web members by plate means positioned at said top portions of the web members, the plate means ultimately being connected to one another only by the sheet-like members previously mentioned. Until substantially all of the sheet-like members are in place the flexural strength of the structure is provided solely by metal frame beams and metal joists lying in a single plane, the sheet-like members providing little or no rigidifying effect until substantially all the sheet-like members are in place. In order to assemble such a structure the metal beams and joists must be supported by a plurality of supports until substantially all of the sheet-like members have been secured to the plate means aforementioned. This is an extremely inconvenient and costly construction system.

SUMMARY OF THE INVENTION

The present invention provides a space frame which can be of smaller depth and less weight than the space frame described in G.B. 2054694B or the structure of Jungbluth with no loss of strength characteristics. Furthermore the constructional techniques employed with the frame of the present invention are simpler and cheaper than those envisaged above in connection with the Jungbluth structure.

In accordance with this invention, there is provided a space frame structure comprising parallel, spaced lower and upper sub-frames joined by interconnecting members, each sub-frame comprising a multiplicity of members connected in a grid, and a concrete layer secured to the upper sub-frame, wherein the concrete layer embeds the grid members of the upper sub-frame in the layer to form a composite upper sub-structure.

In another aspect the invention envisages a method of constructing a space frame structure comprising assembling spaced lower and upper sub-frames joined by interconnecting members, each of said sub-frames comprising a multiplicity of members connected in a grid, supporting shuttering on the upper sub-frame with the upper sub-frame projecting above the shuttering and spreading a layer of concrete over the shuttering and upper sub-frame to provide a concrete layer embedding the grid members of the upper sub-frame in the layer to form a composite upper sub-structure.

The grid members of the upper sub-frame may be much less massive than the grid members of the lower sub-frame. This is because the rigid concrete layer itself forms part of the composite upper sub-structure. The concrete layer as part of the composite upper sub-structure, will be loaded primarily in compression: as concrete is very strong when loaded in compression the concrete layer makes a very substantial contribution to the overall strength of the space frame structure. The strength provided by the grid members of the upper sub-frame is mainly required to support the load of the structure (and the construction workers) during construction, before the freshly poured concrete has set. The whole structure can, therefore, be less heavy than conventional structures and the depth of the structure may also be substantially smaller. As the concrete layer is held in compression in this arrangement, there is no tendency for the layer to crack. During construction of the structure the lower and upper sub-frames and interconnecting members, however, have sufficient strength to support the poured concrete layer. The grid members of the upper sub-frame may have flanges which support permanent shuttering with the grid members projecting above the shuttering, facilitating the pouring of the concrete layer.

The grid members may be I-beams with the shuttering supported on the lower flanges and with the upper flanges embedded in the concrete layer.

The shuttering may comprise a corrugated sheet, which may be made up of channel members secured together, e.g. by concrete-reinforcing rods secured transversely of the channel members.

BRIEF DESCRIPTION OF THE DRAWINGS

Reference is now made to the accompanying drawings, wherein.

DESCRIPTION OF THE PREFERRED EMBODIMENT

The preferred embodiment of a space frame structure according to the invention has a basic metalwork construction generally similar to that disclosed in G.B. 2054694B.

Figure 1:
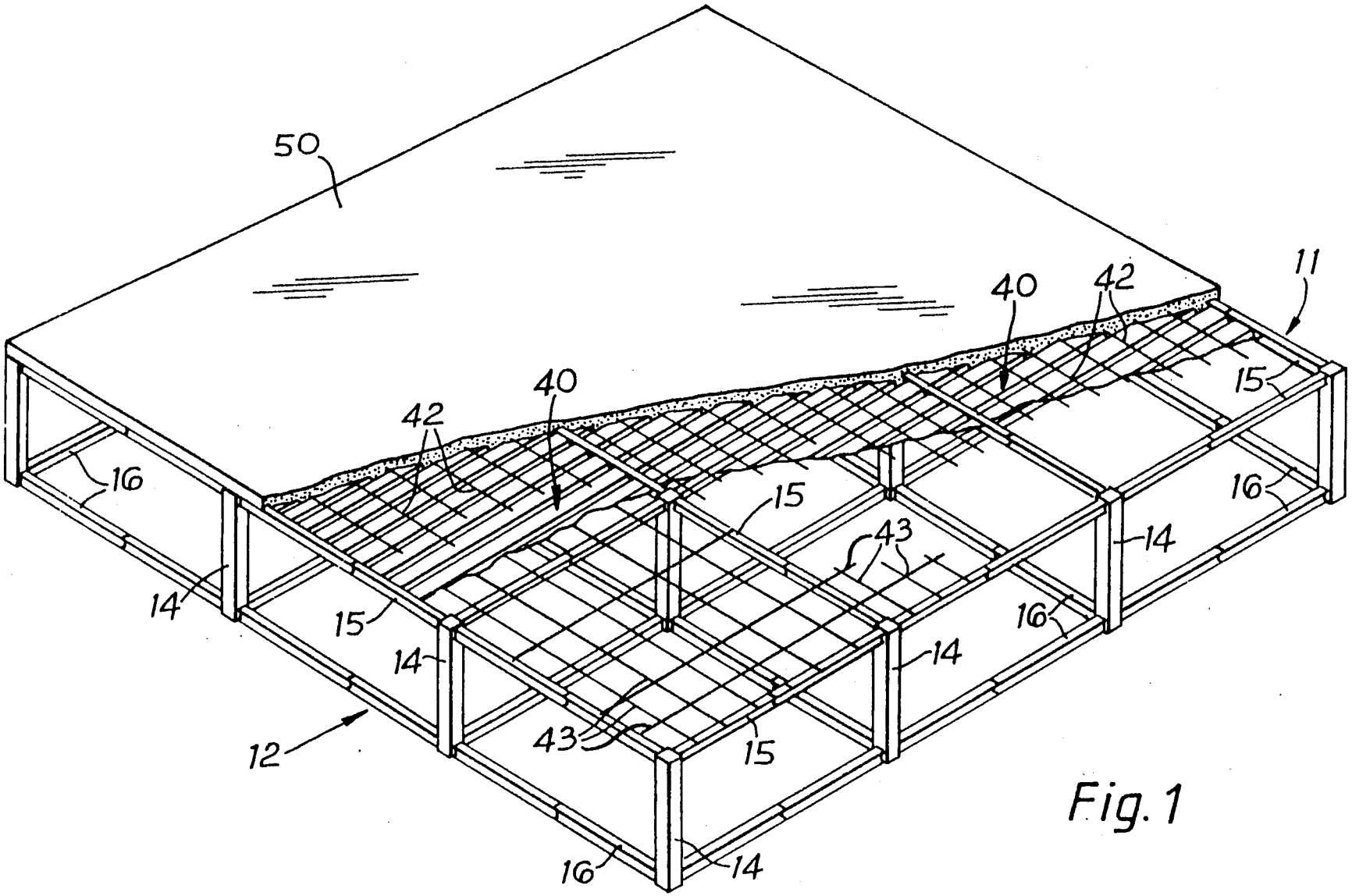
FIG. 1 is a perspective view of a small space frame structure in the preferred embodiment of this invention but with shuttering and a concrete layer partially broken away.

FIG. 1 shows a space frame structure according to the invention which comprises an upper sub-frame 11 comprising a grid of metal members 15 secured together, a parallel lower sub-frame 12, also comprising a grid of metal members 16 secured together and interconnecting members between the grids and comprising upright members 14. This arrangement provides clear channels for provision of services and permits simple construction and assembly. The metal members may be secured together by any suitable means, for example by welding, by fasteners, e.g. bolts of an appropriate number and dimensions or by a combination method, e.g. welded and bolted joints.

Figure 2:
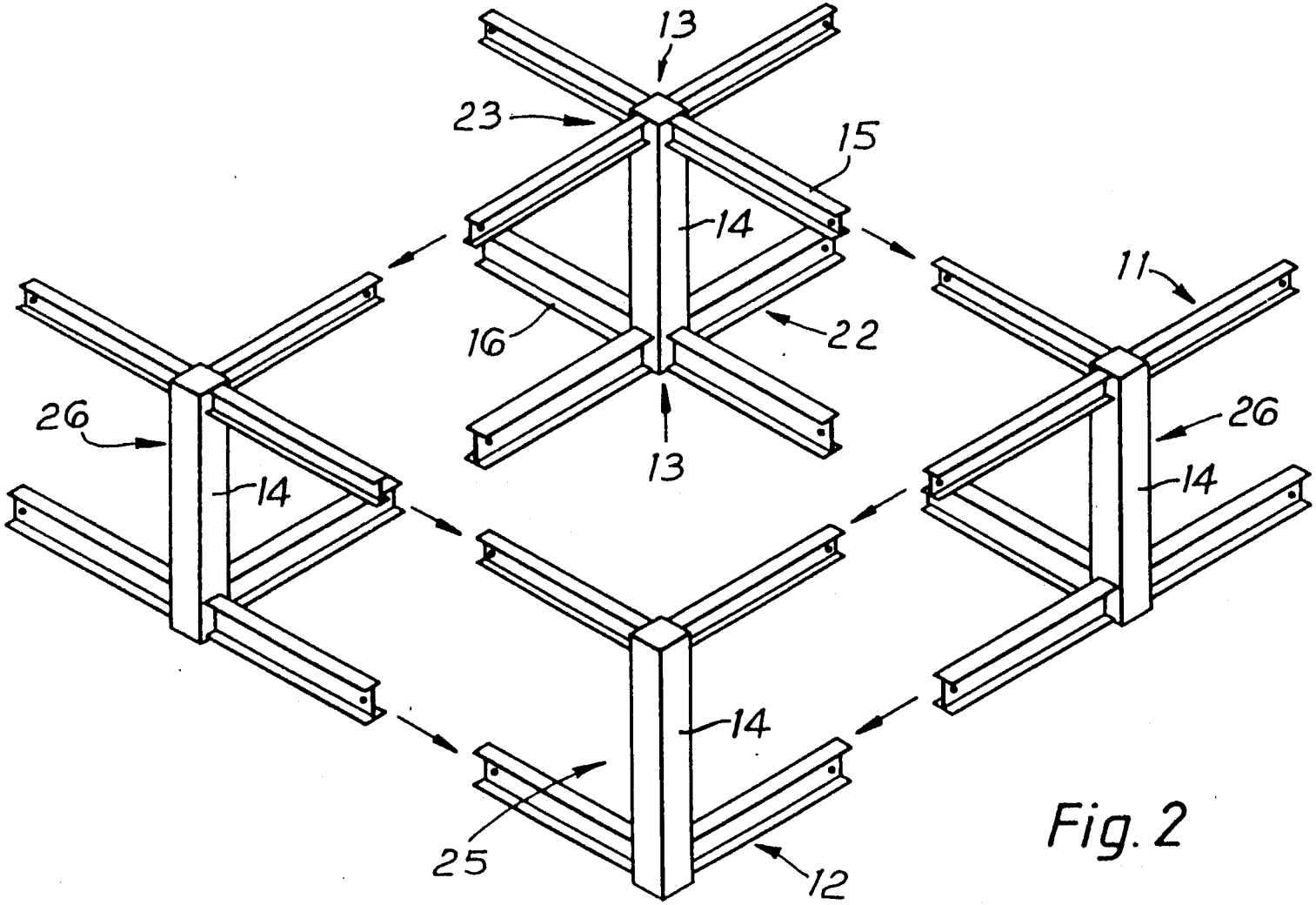
FIG. 2 is an exploded perspective view of a part of the space frame structure.

As shown in FIG. 2, the sub-frames 11, 12 and interconnecting members are composed of a multiplicity of modules generally of the type described in G.B. 2054694B each comprising one upright member 14 which joins a cruciform structure 22, 23 at joints 13 at each end of the uprights. In this preferred embodiment the joints 13 are welded, the modules being prefabricated in a factory using jigs and other suitable equipment. The cruciform structures provide the grid members of the upper and lower sub-frames. Special edge 26 and corner 25 modules are provided. The grid members of each cruciform structure extended orthogonally relative to one another from the joints 13 at the ends of the upright members 14 and are adapted to be connected together, end to end, to form the upper and lower sub-frames 11, 12.

The upper and lower sub-frames and interconnecting members may, however, if desired, be provided by other means.

Figure 4:
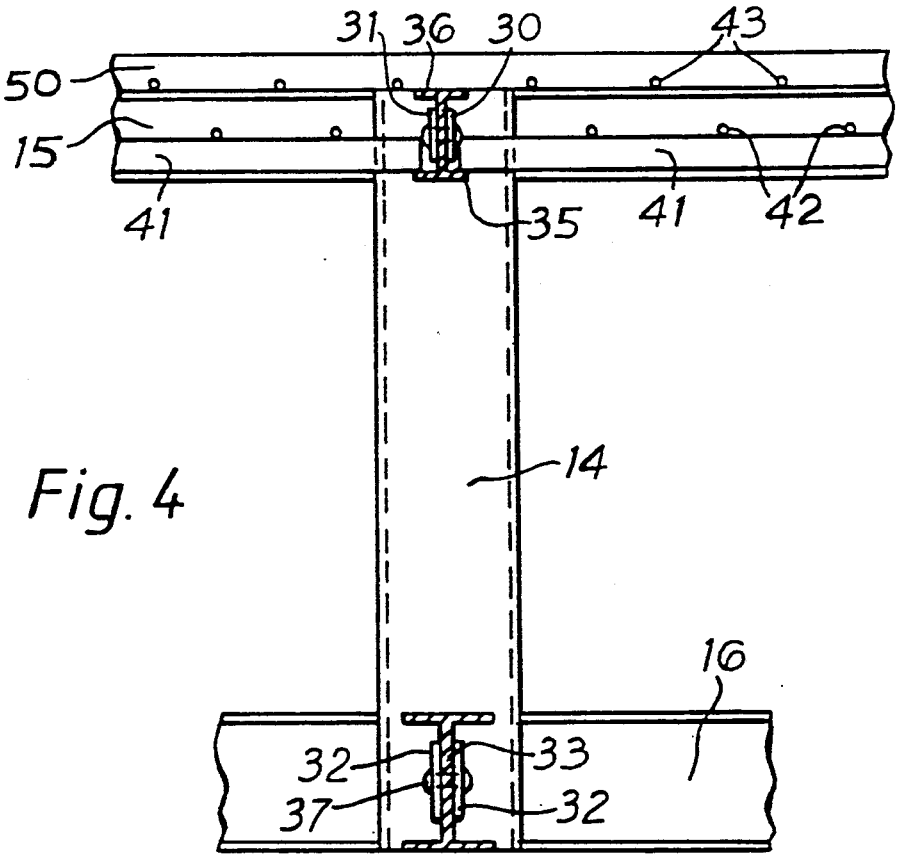
FIG. 4 is a cross-sectional view on the line 4—4 of FIG. 3.
Figure 3:
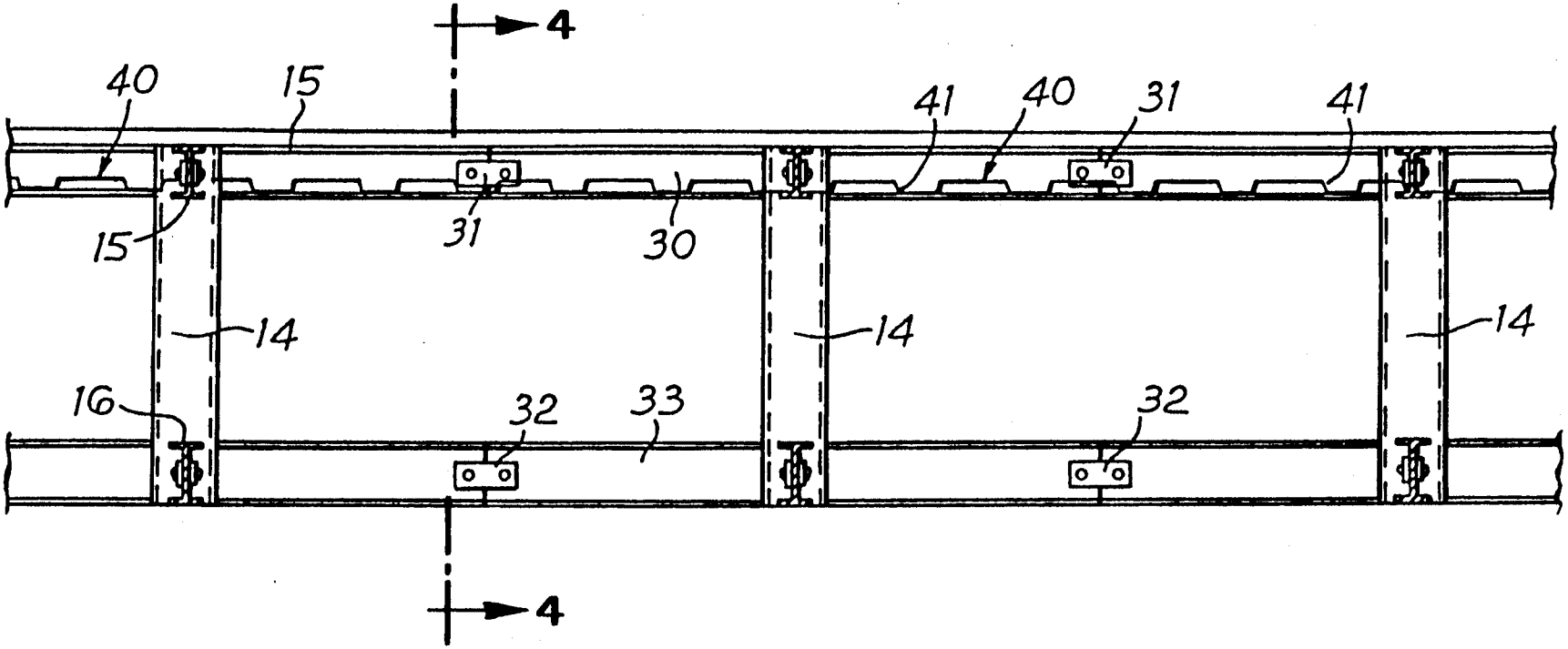
FIG. 3 is a sectional elevation of a part of a space frame structure having a concrete layer embodying the invention.

Referring now especially to FIGS. 3 and 4, each upright member 14 comprises a hollow, square-section metal tube and each grid member 15, 16 of the upper and lower sub-frames 11, 12 comprises an I-section beam having a web and upper and lower flanges. The webs 30 of the upper grid members 15 are joined together, end to end, by fishplates 31 and the webs 33 of the lower grid members 16 are joined together by fishplates 32. The fishplates 31, 32 are preferably provided in pairs, in register at opposite sides of the respective webs 30, 33. For best results one fishplate of each pair is welded to one of the grid members to be joined and the other fishplate of the pair welded to the other grid member. Bolts 37 are then received in aligned holes in the pair of fishplates and the intervening web. Other suitable connection means may, of course, be used if desired. As is evident from FIG. 4, the lower grid members 16 are substantially more massive than the upper grid members 15.

Permanent metal shuttering 40 is supported on the lower flanges 35 of the upper grid members 15. The shuttering comprises a corrugated sheet made up of elongated channel members 41 joined together by transverse concrete reinforcing rods 42 (FIG. 4), conveniently welded to the shuttering 40. Further reinforcing rods may be placed in the channels of the channel members if required. Additional concrete reinforcing grids 43 are laid on the tops of the upper flanges 36 of the upper grid members 15. The shuttering 40 is located wholly within the depth of the upper sub-frame 11 with the upper flanges 36 spaced above the shuttering.

In most applications to construct the space frame structure a number of modules are bolted together, using the fishplate 31, on the ground to produce a section of the space frame metalwork which is lifted into place using a crane. A number of such sections are secured together and to the remainder of the building structure where appropriate to provide a self-supporting portion of the final space-frame structure, to which further sections are secured until the whole of the metalwork sub-structure is in place. The sections permanently secured in place then provide a support, at least in part, for succeeding sections of the space frame structure. By careful choice of the size of the sections and the order in which they are secured to one another a very large area of metal work can be assembled without using either temporary supports or a very large crane capable of lifting the whole metalwork structure. The shuttering is preferably assembled with the sections before they are lifted into place. Finally a layer of concrete is poured over the shuttering, covering the upper flanges 36 of the upper grid members 15, the reinforcement (rods 42 and grids 43) and the upper joints 13, and smoothed to provide a uniform layer. On setting of the concrete, the so-formed concrete layer 50 becomes firmly bound to the upper grid members 15, the members 15 being firmly embedded in the layer 50.

The grid members 15 of the upper sub-frame 11 have sufficient strength to carry the loads required during construction, but not sufficient to meet the requirements of subsequent use. The loads to be carried during construction include the weight of the frame itself, the weight of the wet concrete laid on the shuttering and the weight of operatives laying the concrete.

The wet concrete is laid on the shuttering 40 to a depth sufficient to engulf the upper flanges 36 of the upper grid members 15 and the additional concrete-reinforcing grids 43, as well as the reinforcing rods 42, and allowed to set.

Once the concrete has set rigid, the concrete layer 50, the shuttering and the upper grid members 15 form a composite sub-structure which, together with the lower sub-frame 12 is sufficiently strong to meet full floor-loading requirements. As the concrete layer 50 of the upper sub-structure is loaded primarily in compression (concrete under compressive load being very strong) the layer 50 contributes substantially to the strength of the structure.

The loading requirements during construction are only one quarter to one third the requirements for full floor-loading.

Although, in the illustrative structure the upper and lower sub-frames are both planar, and the grid members project orthogonally to the interconnecting members, as well as one another, a structure in accordance with the invention may be arranged so that the concrete layer is pitched very slightly, typically at an angle of 1°-2° to the horizontal, e.g. to provide a roof structure: in this case some of the grid-members may be disposed other than orthogonally to the interconnecting members though still being orthogonal to one another and lying in a plane with the planes of the upper and lower grid members substantially parallel.

Figure 5:
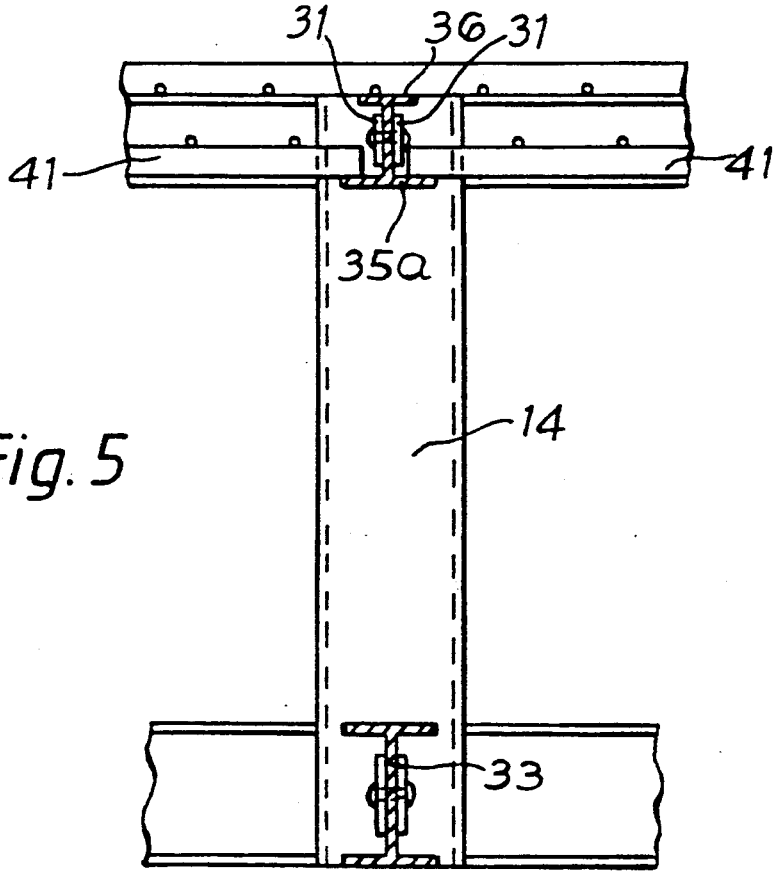
FIG. 5 is a similar view to FIG. 4 of a modified construction.

FIG. 5 shows a modification in which the lower flanges **35*a* of the upper grid members 15 are greater in area than the upper flanges 36**. This facilitates laying of the shuttering as well as increasing the strength, without having to make the rest of the grid members more massive.

The resultant space-frame structure may have the upper concrete surface used as a floor and the lower surface of the lower sub-frame 12 clad as a ceiling. The space below the concrete layer 50 and above the lower sub-frame 12 may receive service lines.

What is claimed is:

1. A structural module for use in constructing a space frame structure, comprising an upper grid forming section having a plurality of orthogonally arranged grid members, a lower grid forming section having a plurality of orthogonally arranged grid members and an interconnecting member interconnecting said sections and secured thereto, wherein the grid members of the lower grid forming section are more massive than those of the upper grid forming section and the grid members are each adapted for connection end to end with an grid member of a corresponding section of another similar module.

2. A space frame structure comprising an upper sub-frame comprising a multiplicity of upper space frame members connected together to form an upper grid, each said member having an upper surface and a lower surface defining a depth for said member; a lower sub-frame spaced from and parallel to the upper sub-frame and comprising a multiplicity of lower space frame members connected together to form a lower grid; interconnecting members joining said upper and lower sub-frames; and a concrete layer secured to the upper sub-frame; the concrete layer extending below the upper surfaces of the upper space frame members wherein the latter members are at least partially embedded in the concrete.

3. A space frame structure according to claim 2 wherein the space frame members of the upper sub-frame are less massive than the space frame members of the lower sub-frame.

4. A space frame structure according to claim 2 comprising permanent shuttering supported by the space frame members of the upper sub-frame within the depth of the upper space frame members, the concrete layer being laid on the shuttering.

5. A space frame structure according to claim 2 comprising permanent shuttering supported by the space frame members of the upper sub-frame within the depth of the upper space frame members, the concrete layer being laid on the shuttering, wherein the shuttering forms part of the composite structure and reinforces the concrete layer.

6. A space frame structure according to claim 2 comprising permanent shuttering supported by the space frame members of the upper sub-frame within the depth of the upper space frame members, the concrete layer being laid on the shuttering, wherein the shuttering is of corrugated form.

7. A space frame structure according to claim 2 comprising permanent shuttering supported by the space frame members of the upper sub-frame within the depth of the upper space frame members, the concrete layer being laid on the shuttering, wherein the shuttering is of corrugated form and includes reinforcing rods secured transversely of the corrugations and embedded in the concrete layer.

8. A space frame structure according to claim 2 comprising permanent shuttering supported by the space frame members of the upper sub-frame within the depth of the upper space frame members, the concrete layer being laid on the shuttering, wherein the space frame members of the upper sub-frame have lower flanges which support the shuttering.

9. A space frame structure according to claim 2 comprising permanent shuttering supported by the space frame members of the upper sub-frame within the depth of the upper space frame members, the concrete layer being laid on the shuttering, wherein the space frame members of the upper sub-frame have lower flanges which support the shuttering and upper flanges which are embedded in the concrete layer.

10. A space frame structure according to claim 2 comprising permanent shuttering supported by the space frame members of the upper sub-frame within the depth of the upper space frame members, the concrete layer being laid on the shuttering, wherein the space frame members of the upper sub-frame have lower flanges which support the shuttering and upper flanges which are embedded in the concrete layer, and wherein the upper flanges are smaller than the lower flanges.

11. A space frame structure according to claim 2 wherein the upper and lower sub-frames and interconnecting members comprise a multiplicity of modules connected together, each of said interconnecting members having a top end at which it is joined to the upper sub-frame and a bottom end at which it is joined to the lower sub-frame, each of substantially all the modules comprising one of the interconnecting members, at least three upper space frame members forming parts of the upper sub-frame and extending orthogonally relative to one another from the top end of said interconnecting member and at least three lower space frame members forming parts of the lower sub-frame and extending orthogonally relative to one another from the bottom end of said interconnecting member, each upper space frame member being connected end to end with an upper space frame member of another module and each other lower space frame member being connected end to end with a lower space frame member of said other module.

12. A method of constructing a space frame structure comprising the steps of assembling a structure comprising an upper sub-frame comprising a multiplicity of upper space frame members connected together to form an upper grid, a lower sub-frame spaced from and parallel to the upper sub-frame and comprising a multiplicity of lower space frame members connected together to form a lower grid, and interconnecting members joining said upper and lower sub-frames; supporting shuttering on the upper sub-frame with the upper sub-frame projecting above the shuttering; and spreading a layer of concrete to provide a concrete layer over the shuttering and upper sub-frame embedding the space frame members of the upper sub-frame in the layer to form a composite upper sub-structure.

* * * * *